US011105572B1

(12) United States Patent
Lee

(10) Patent No.: US 11,105,572 B1
(45) Date of Patent: Aug. 31, 2021

(54) MODULAR FORWARD ASSIST FOR FIREARMS

(71) Applicant: Strike Industries, Inc., Santa Ana, CA (US)

(72) Inventor: Shanyao Lee, Santa Ana, CA (US)

(73) Assignee: Strike Industries, Inc., Santa Ana, CA (US)

( * ) Notice: Subject to any disclaimer, the term of this patent is extended or adjusted under 35 U.S.C. 154(b) by 0 days.

(21) Appl. No.: 16/910,487

(22) Filed: Jun. 24, 2020

(51) Int. Cl.
*F41A 3/72* (2006.01)
*F41A 3/66* (2006.01)

(52) U.S. Cl.
CPC . *F41A 3/72* (2013.01); *F41A 3/66* (2013.01)

(58) Field of Classification Search
CPC ..... F41A 35/00; F41A 35/06
See application file for complete search history.

(56) References Cited

U.S. PATENT DOCUMENTS 3,236,155 A * 2/1966 Sturtevant ..... F41A 3/18 89/199
5,551,179 A * 9/1996 Young ..... F41A 3/12 42/16
7,958,661 B2 * 6/2011 Strayer ..... F41A 35/06 42/50
D759,780 S * 6/2016 Wang ..... D22/108
9,470,472 B2 * 10/2016 Kincel ..... F41G 11/003
9,518,792 B1 * 12/2016 Huang ..... F41A 35/00
9,739,553 B1 * 8/2017 Gibbons, III ..... F41A 11/02
10,132,580 B1 * 11/2018 Kincel ..... F41A 7/00
10,302,381 B1 * 5/2019 Huang ..... F41A 3/66
10,563,939 B1 * 2/2020 Oglesby ..... F41A 3/38
10,677,549 B2 * 6/2020 Kincel ..... F41A 3/72
2011/0252957 A1 * 10/2011 Overstreet ..... F41A 3/72 89/128
2015/0362270 A1 * 12/2015 Stewart ..... F41A 35/06 42/16
2018/0087860 A1 * 3/2018 Sullivan ..... F41A 19/14

* cited by examiner

*Primary Examiner* — Derrick R Morgan
(74) *Attorney, Agent, or Firm* — Han IP PLLC; Andy M. Han

(57) ABSTRACT

A device implementable on a firearm includes a forward assist assembly which is configured to be installed on an upper receiver of the firearm. When pressed, the forward assist assembly moves along a longitudinal axis thereof to engage with a serration cut on a bolt carrier of the firearm to push the bolt carrier forward with respect to the upper receiver when pressed. The forward assist assembly includes a modular component slidingly attachable to and detachable from the forward assist assembly.

15 Claims, 7 Drawing Sheets

MODULAR FORWARD ASSIST FOR FIREARMS

TECHNICAL FIELD

The present disclosure is generally related to firearm accessories and, more particularly, to a modular forward assist for firearms.

BACKGROUND

Unless otherwise indicated herein, approaches described in this section are not prior art to the claims listed below and are not admitted as prior art by inclusion in this section.

On certain types of firearms (e.g., firearms based on an AR platform such as AR15-styled or AR10-styled rifles, carbines, pistols and shotguns), an upper receiver of the firearm is typically equipped with a forward assist. The forward assist is typically a button located behind the shell deflector on the upper receiver, and it can be used to move a bolt or bolt carrier group of the firearm fully forward. The forward assist is useful when a return spring of the firearm does not properly return the bolt or bolt carrier group to its fully forward position. When pressed by the user, the forward assist pushes the bolt or bolt carrier forward to ensure that the bolt carrier group is closed and the bolt is locked.

With conventional and currently-available forward assists on the market, in case a user of a firearm desires to customize the forward assist of the firearm the user would likely need to use special tool(s) to disassemble or otherwise uninstall the forward assist assembly in order to replace one or more components thereof for customization. This, however, tends to be time consuming and troublesome, especially if the use does not already of the special tool(s) required for disassembly. Therefore, there is a need for a solution that requires minimal amount of disassembly and enables customization of a forward assist in a relatively short amount of time.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

In view of the aforementioned issues, an objective of the present disclosure is to propose innovative designs of a modular forward assist. It is believed that the proposed designs can avoid or otherwise minimize aforementioned issues associated with conventional forward assists. That is, the modularity of the proposed designs require minimal disassembly and, hence, enable quick replacement of one or more components for customization without the need of any special tools.

In one aspect, a device implementable on a firearm based on an AR platform (e.g., AR15 platform or AR10 platform) may include a forward assist assembly configured to be installed on an upper receiver of the firearm. When pressed, the forward assist assembly may move along a longitudinal axis thereof to engage with a serration cut on a bolt carrier of the firearm to push the bolt carrier forward with respect to the upper receiver when pressed. The forward assist assembly may include a modular component slidingly attachable to and detachable from the forward assist assembly.

In another aspect, a device implementable on a firearm based on an AR platform (e.g., AR15 platform or AR10 platform) may include a forward assist assembly configured to be installed on an upper receiver of the firearm. The forward assist assembly may include a plunger and a button. The plunger, when the forward assist assembly is pressed by a user, may move along a longitudinal axis of the forward assist assembly to cause a bolt carrier of the firearm to move forward with respect to the upper receiver. The button may be configured to be slidingly attached to and detached from the plunger.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, explain the principles of the disclosure. It is appreciable that the drawings are not necessarily in scale as some components may be shown to be out of proportion than the size in actual implementation to clearly illustrate the concept of the present disclosure.

DETAILED DESCRIPTION OF PREFERRED IMPLEMENTATIONS

Figure 1:
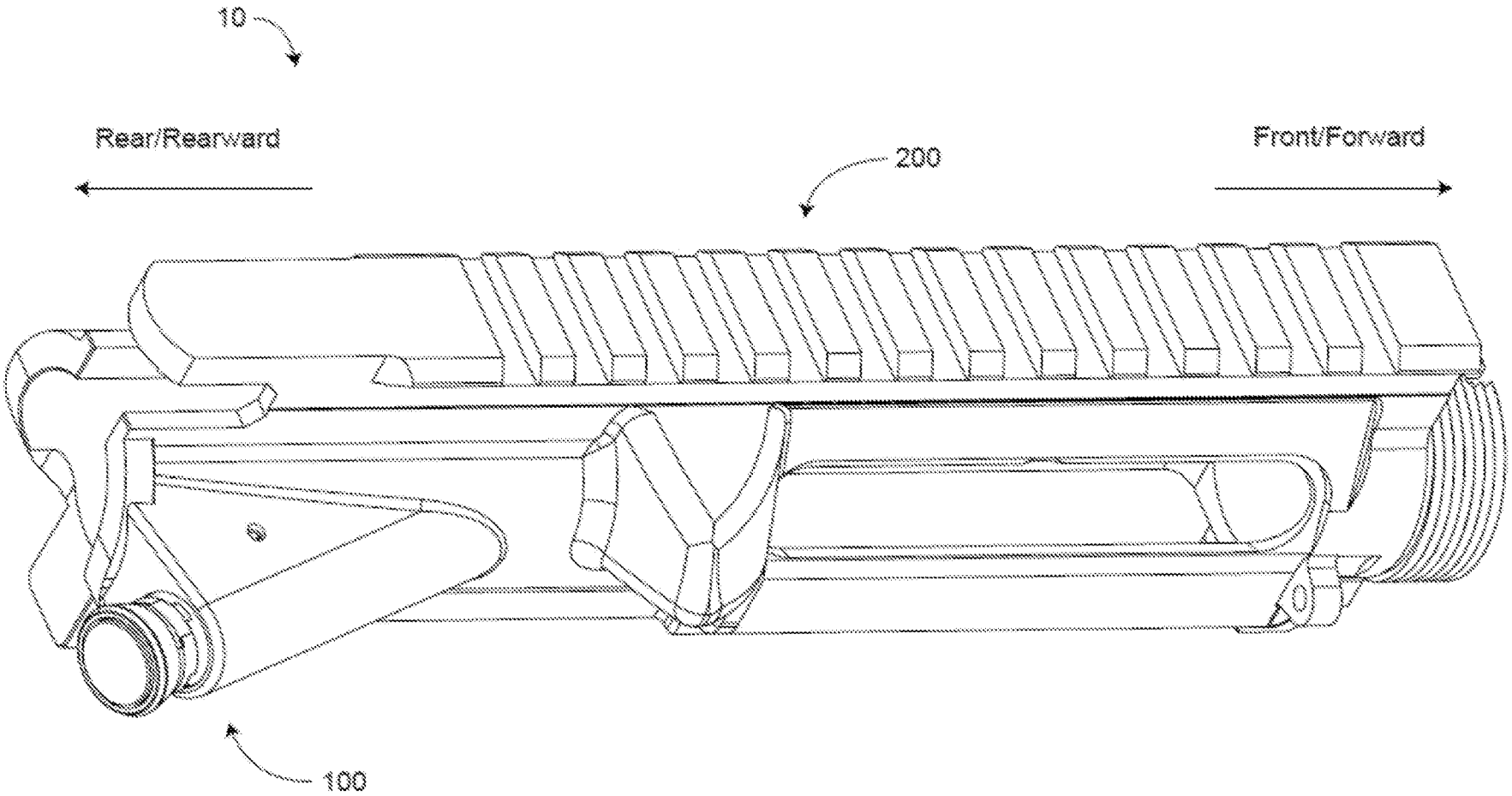
FIG. 1 is a diagram of an apparatus in accordance with an implementation of the present disclosure.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

As used herein, the terms "proximal" and "proximally" may denote "forward" and "forwardly" with respect to the firearm, and the terms "distal" and "distally" may denote "rearward" and "rearwardly" with respect to the firearm. As used herein, the verb "to comprise" in this description, claims, and other conjugations are used in its non-limiting sense to mean those items following the word are included, but items not specifically mentioned are not excluded. As used herein, the word "forward" means moving in the direction that the projectile moves during firing a firearm. As used herein, the word "proximal" means closer to the reference point, in this case, the shooter. As used herein, the word "distal" means farther to the reference point, in this case, the shooter. Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure. The recitation of numerical ranges by endpoints includes all numbers within that range (e.g., 1 to 5 includes 1, 1.5, 2, 2.75, 3, 3.80, 4, and 5). All dimensions given herein are by way of examples to better illustrate the present disclosure embodiments and shall not be construed to limit the dimensions of the present disclosure embodiments to the given numeric values.

Overview

FIG. 1 illustrates an apparatus 10 in accordance with an implementation of the present disclosure. Referring to FIG. 1, apparatus 10 may include a device and an upper receiver 200 of a firearm such as a firearm based on an AR platform such as an AR15-styled or an AR10-styled rifle, carbine, pistol or shotgun (not shown). Upper receiver 200 may have a cavity therein and may be configured with a front opening (e.g., to receive a barrel of the firearm), a rear opening (e.g., to receive a buffer tube of the firearm), a lower opening (e.g., to receive/mate with a lower receiver of the firearm), and an ejection port through which spent casings/shells of fired ammunition cartridges may be ejected out of the firearm. In the interest of brevity and to avoid obscuring the figures, none of the barrel, butter tube, lower receiver and other components typically found on a firearm based on an AR platform, which is not relevant to the proposed design, is shown. The device, including or as a forward assist assembly 100, may be configured to be installed on upper receiver 200. When pressed by a user, forward assist assembly 100 may move along a longitudinal axis thereof to engage with a serration cut on a bolt carrier (not shown) of the firearm to push the bolt carrier forward with respect to upper receiver 200 when pressed. Under a proposed design in accordance with the present disclosure, forward assist assembly 100 may include a modular component slidingly attachable to and detachable from forward assist assembly 100 in directions at an angle θ measured from the longitudinal axis in a range of $30° \leq \theta \leq 150°$ (or $45° \leq \theta \leq 90°$) relative to the longitudinal axis. In some implementations, the modular component may be slidingly attachable to and detachable from forward assist assembly 100 in directions perpendicular (e.g., $\theta = 90°$) to the longitudinal axis (e.g., radially toward the longitudinal axis when being attached and radially away from the longitudinal axis when being detached).

Figure 2:
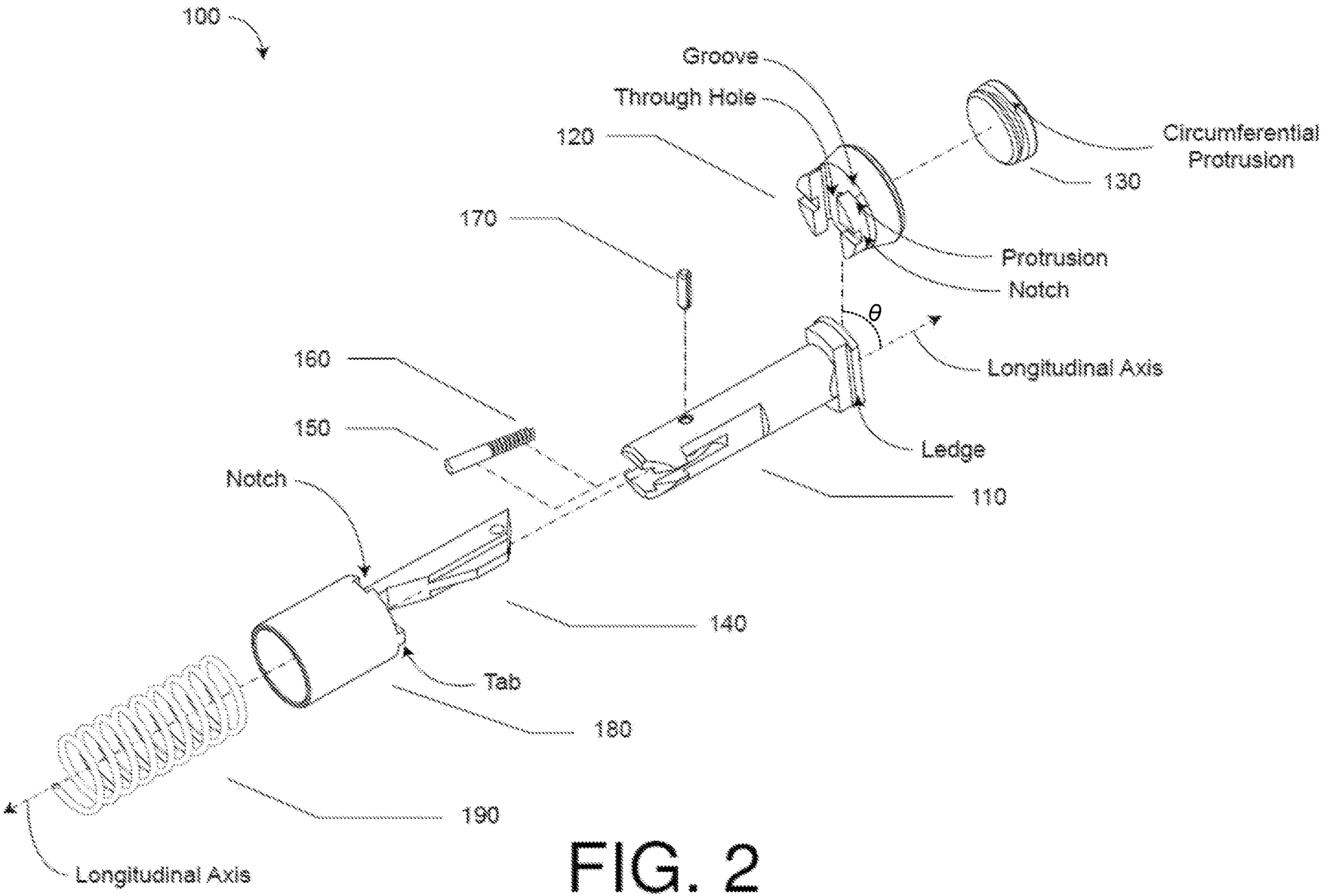
FIG. 2 is a diagram of an exploded view of a device in accordance with an implementation of the present disclosure.

FIG. 2 illustrates an exploded view of forward assist assembly 100 in accordance with an implementation of the present disclosure. Referring to FIG. 2, forward assist assembly 100 may include a plunger 110, a button 120 as a part of the modular component, and a button cover 130 as another part of the modular component. When forward assist assembly 100 is pressed by a user, plunger 110 may move along the longitudinal axis of forward assist assembly 100 to cause the bolt carrier of the firearm to move forward with respect to upper receiver 200. Button 120 may be configured to be slidingly attachable to and detachable from plunger 110 in directions at an angle θ measured from the longitudinal axis in a range of $30° \leq \theta \leq 150°$ (or $45° \leq \theta \leq 90°$) relative to the longitudinal axis. In some implementations, button 120 may be slidingly attachable to and detachable from forward assist assembly 100 in directions perpendicular (e.g., $\theta = 90°$) to the longitudinal axis (e.g., radially toward the longitudinal axis when being attached and radially away from the longitudinal axis when being detached).

Referring to FIG. 2, forward assist assembly 100 may further include a forward assist spring 190, a forward assist pawl 140, a pawl detent 150, a pawl detent spring 160, a pawl spring pin 170, and a plunger cover 180 with a generally cylindrical shape. When forward assist assembly 100 is assembled and installed on upper receiver 200 of the firearm, the following may occur: (a) button 120 may be slidingly attachable to and detachable from a first distal end of plunger 110 (e.g., the distal end pointing generally toward the rear of the firearm when installed on upper receiver 200), (b) forward assist pawl 140 may be secured to a second distal end of plunger 110 (e.g., the distal end pointing generally toward the front of the firearm when installed on upper receiver 200) opposite the first distal end thereof by pawl spring pin 170 with pawl detent 150 and pawl detent spring 160 disposed between plunger 110 and forward assist pawl 140, and (c) plunger cover 180 may surround plunger 110 with a first end of plunger cover 180 (e.g., the end pointing generally toward the rear of the firearm when installed on upper receiver 200) in contact with button 120 and a second end of plunger cover 180 (e.g., the distal end pointing generally toward the front of the firearm when installed on upper receiver 200) opposite the first end thereof in contact with forward assist spring 190. Each of forward assist spring 190 and pawl detent spring 160 may be shown as a helical compression spring but any other suitable spring may be utilized as an alternative.

Under a proposed design in accordance with the present disclosure, button 120 may have a first primary side (e.g., the side facing plunger 110 when assembled) and a second primary side (e.g., the side facing button cover 130 when assembled) opposite the first primary side. The first primary side may be configured with two protrusions on two opposite ends of the first primary side. Each of the two protrusions may be configured with a groove. When button 120 is slidingly attached to plunger 110, ledges on the first distal end of plunger 110 may be received in the grooves on the two protrusions.

Under the proposed design, button cover 130 may be configured to be detachably attached to the second primary side of button 120. In some implementations, the second primary side of button 120 may have an indentation configured to receive a mating portion of button cover 130 therein. For instance, the second primary side of button 120 may also have a circumferential protrusion around in inner wall of the indentation. The mating portion of button cover 130 may have a circumferential groove around the mating portion thereof. When button cover 130 is attached to the second primary side of button 120, the circumferential groove of the mating portion of button cover 130 may be received in the circumferential protrusion of the indentation of button 120. Alternatively, the second primary side of button 120 may also have a circumferential groove around in inner wall of the indentation. The mating portion of button cover 130 may have a circumferential protrusion around the mating portion thereof. When button cover 130 is attached to the second primary side of button 120, the circumferential protrusion of the mating portion of button cover 130 may be received in the circumferential groove of the indentation of button 120. Advantageously, this design allows button cover 130 to be snapped on to button 120 on the second primary side thereof (e.g., when pressed toward button 120 in a direction from the second primary side of button 120 toward the first primary side of button 120).

Under a proposed design in accordance with the present disclosure, button 120 may have a through hole communicatively connecting the first primary side and the second primary side of button 120. Accordingly, when button cover 130 is attached to button 120, a portion of button cover 130 may be exposed to the first primary side of button 120 via the through hole. Advantageously, this design allows button cover 130 to be snapped off from button 120 (e.g., when pushed via the through hole in a direction from the first primary side of button 120 toward the second primary side of button 120).

Under a proposed design in accordance with the present disclosure, each of the two protrusions on the first primary side of button 120 may have a notch. The first end of plunger cover 180 may correspondingly have two tabs. When forward assist assembly 100 is assembled, the two tabs on the first end of plunger cover 180 may be received in the notches of the two protrusions of button 120. Advantageously, this design allows button 120 to be interlockingly received on forward assist assembly 110 as the tabs on plunger cover 180 interlock with the notches on button 120 interlock with plunger cover 180 being pushed toward button 120 due to the force exerted by forward assist spring 190.

Under a proposed design in accordance with the present disclosure, the first end of plunger cover 180 may have a notch. When forward assist assembly 100 is assembled, a portion of the first distal end of plunger 110 may be visible through the notch of plunger cover 180. Advantageously, this design allows a user to pry open the interlocks between the tabs on plunger cover 180 and the notches on button 120 by inserting an object (e.g., a tip of the user's finger, a tip of a pen or a tip of a screwdriver) in the notch and push plunger cover 180 forward to compress forward assist spring 190, thereby allowing button 120 to be slid in a direction at an angle θ measured from the longitudinal axis in a range of $30° \leq \theta \leq 150°$ (or $45° \leq \theta \leq 90°$) relative to the longitudinal axis. In some implementations, button 120 may be slidingly attachable to and detachable from forward assist assembly 100 in directions perpendicular (e.g., $\theta = 90°$) to the longitudinal axis of forward assist assembly 100 to be detached from plunger 110.

Figure 3:
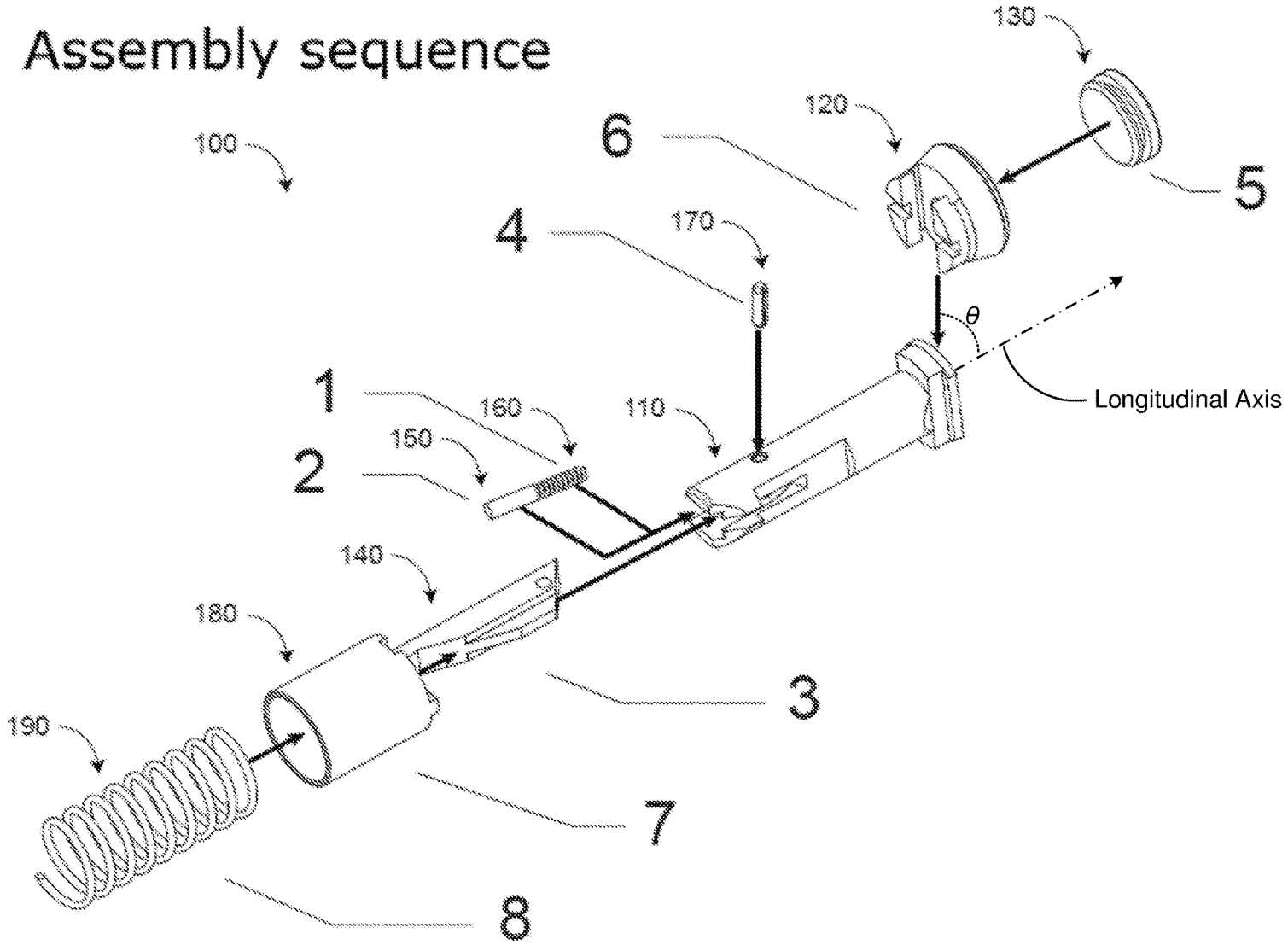
FIG. 3 is a diagram of an example assembly sequence of a device in accordance with an implementation of the present disclosure.

FIG. 3 illustrates an example assembly sequence of forward assist assembly 100 in accordance with an implementation of the present disclosure. Initially (labeled as steps 1, 2 and 3 in FIG. 3), pawl detent 150 and pawl detent spring 160 may be disposed between plunger 110 and forward assist pawl 140. At step 4, with pawl detent spring 160 compressed, pawl spring pin 170 may be inserted into a receiving hole on plunger 110 and through a corresponding through hole on forward assist pawl 140 to secure forward assist pawl 140 to plunger 110. At step 5, button cover 130 may be attached to (e.g., snapped on) the second primary side of button 120. At step 6, button 120 may be slid onto the first distal end of plunger 110 with ledges on two opposite sides of the first distal end of plunger 110 received in corresponding grooves on the two protrusions on the first primary side of button 120. At step 7, plunger cover 180 may be slid up from the second distal end of plunger 110 toward the first distal end thereof as well as button 120 so that at least a portion of plunger 110 is surrounded or otherwise encircled by plunger cover 180. At step 9, with forward assist spring 190 on the second end of plunger cover 180, forward assist assembly 100 may be inserted into a forward assist receptable or housing on upper receiver 200 to be installed on upper receiver 200.

Figure 4:
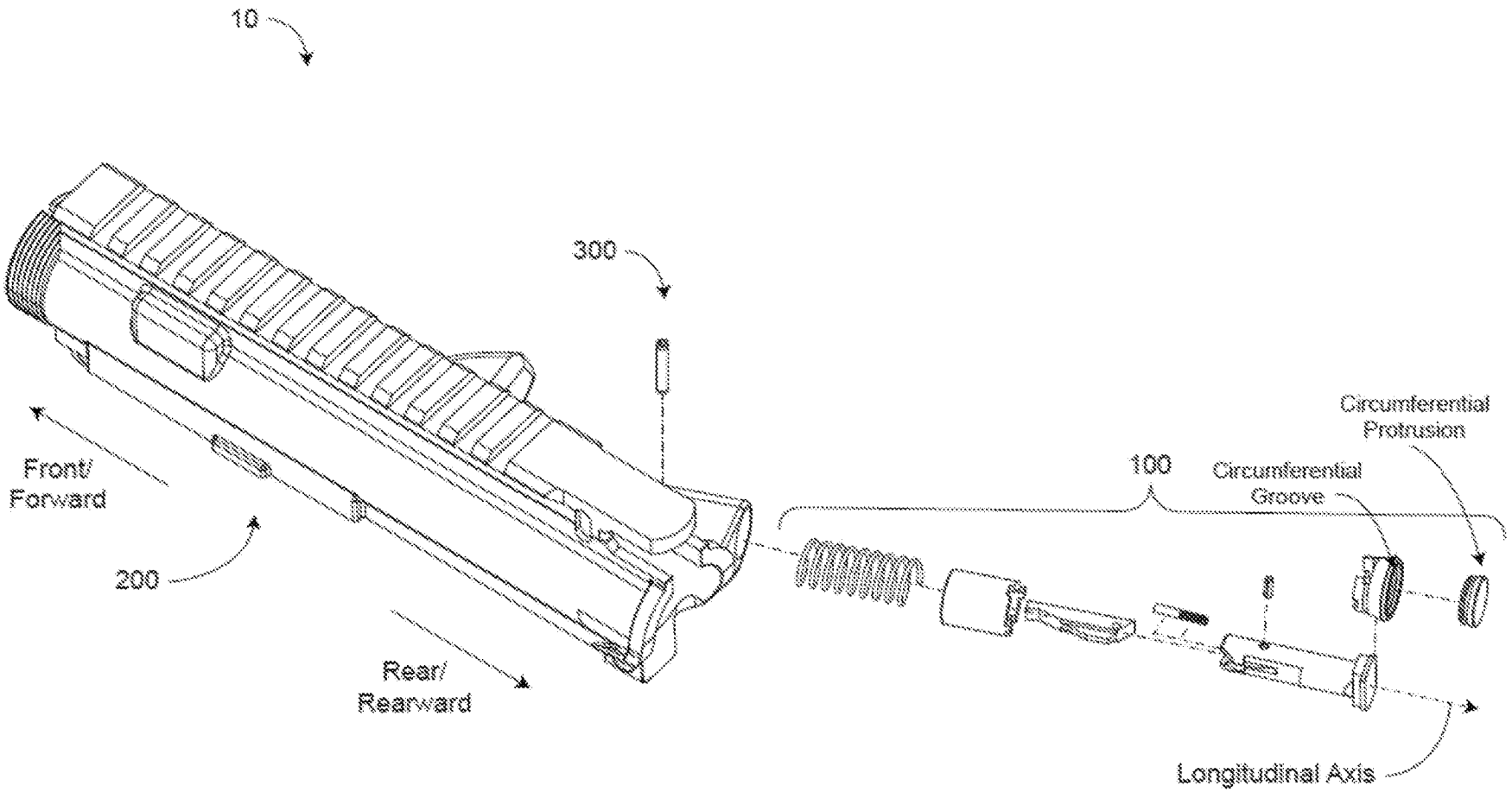
FIG. 4 is a diagram of an example assembly of an apparatus in accordance with an implementation of the present disclosure.
Figure 5:
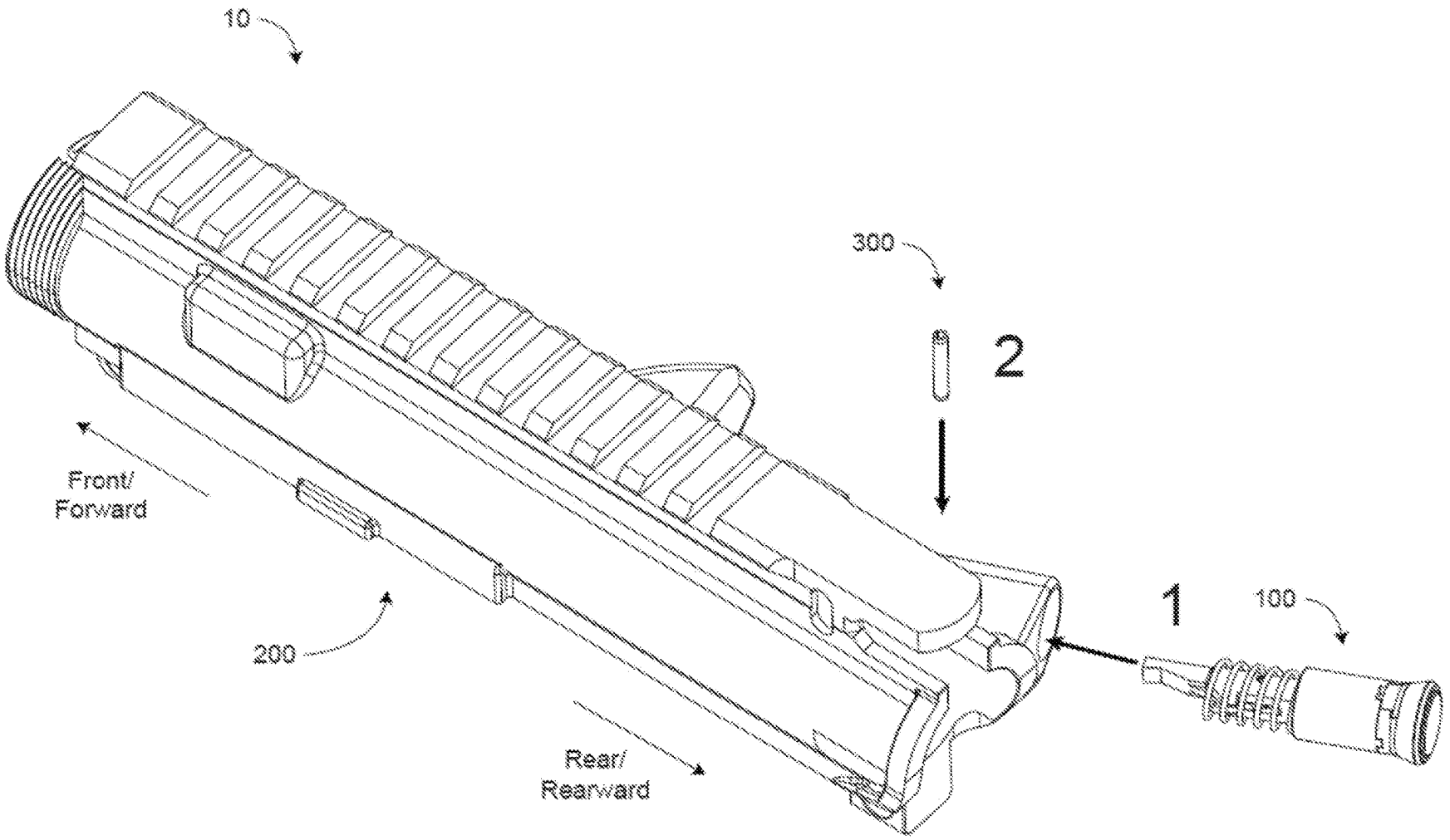
FIG. 5 is a diagram of an example assembly sequence of an apparatus in accordance with an implementation of the present disclosure.

Each of FIG. 4 and FIG. 5 illustrates an example assembly of apparatus 10 in accordance with an implementation of the present disclosure. Referring to FIG. 4 and FIG. 5, forward assist assembly 100 may be secured onto upper receiver 200 by the use of a forward assist spring pin 300 (or any other suitable means).

Figure 6:
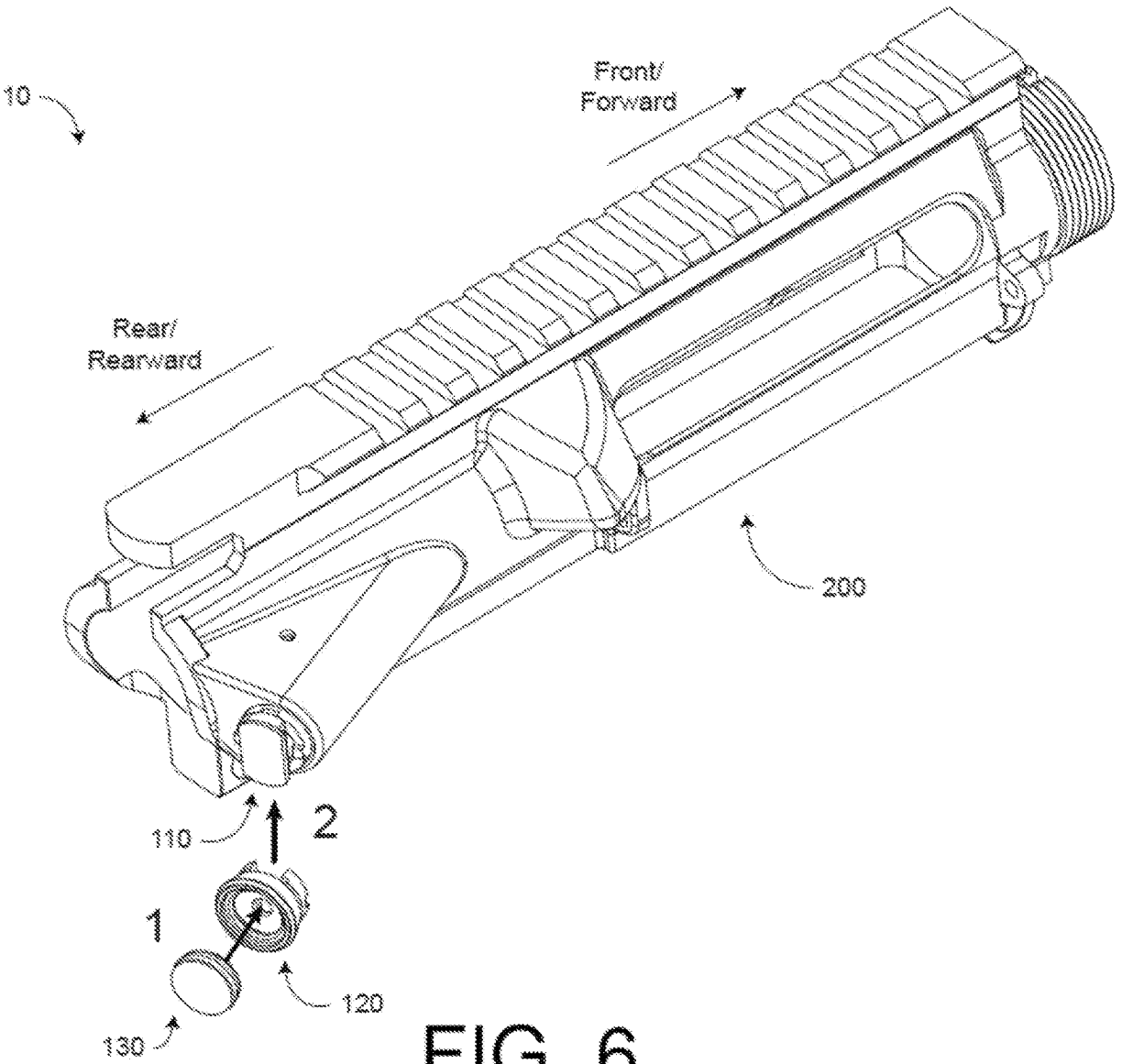
FIG. 6 is a diagram of an example assembly sequence of a modular component of a device in accordance with an implementation of the present disclosure.

FIG. 6 illustrates an example assembly sequence of a modular component of forward assist assembly 100 in accordance with an implementation of the present disclosure. In the example shown in FIG. 6, as a modular component, button cover 130 may be snapped onto the second primary side of button 120. Moreover, as another modular component, button cover 130 may be slid onto the first distal end of plunger 110 upwardly with respect to upper receiver 200, which is generally in a direction at an angle θ measured from the longitudinal axis in a range of $30° \leq \theta \leq 150°$ (or $45° \leq \theta \leq 90°$) relative to the longitudinal axis of forward assist assembly 100.

Figure 7:
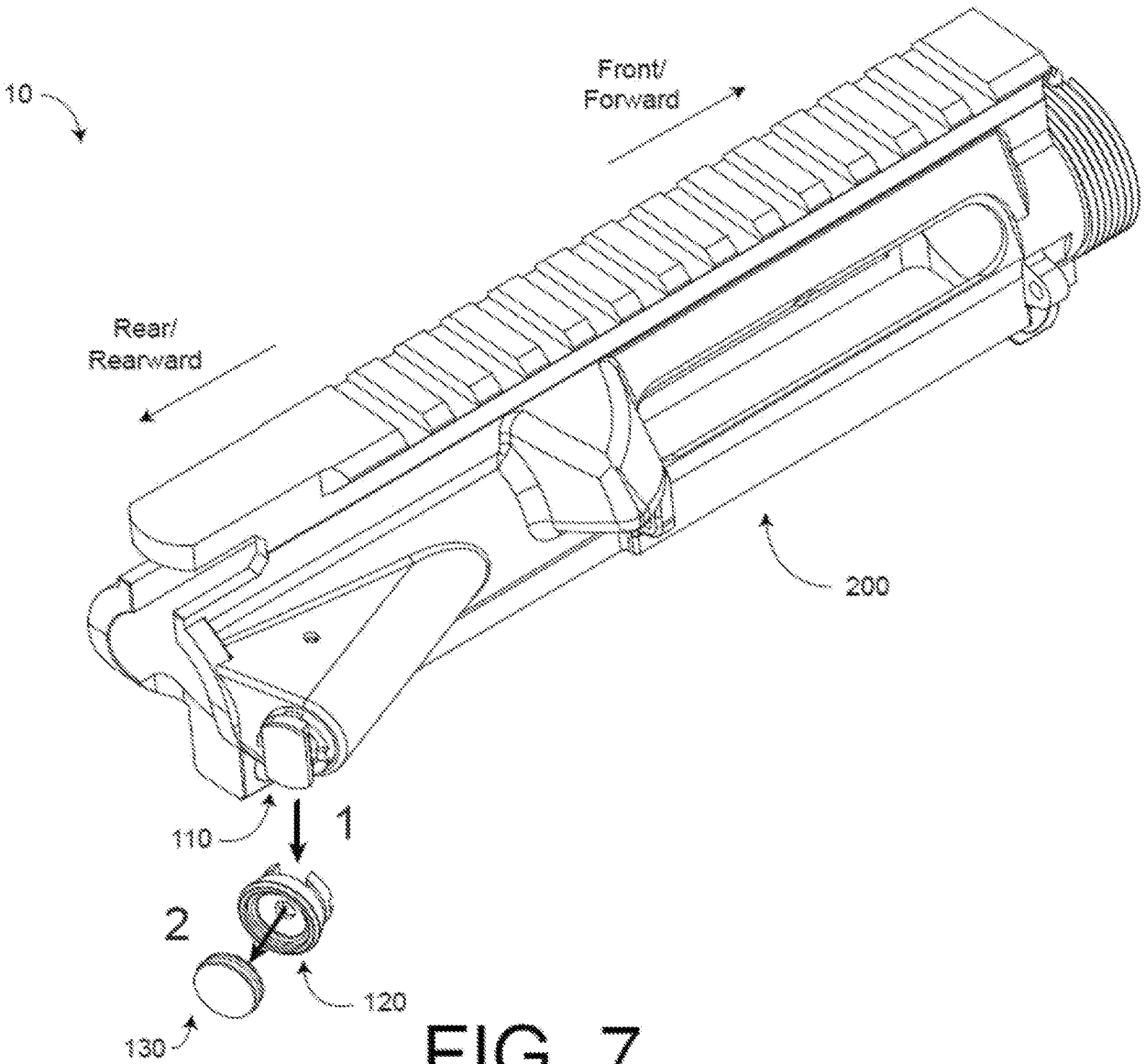
FIG. 7 is a diagram of an example disassembly sequence of a modular component of a device in accordance with an implementation of the present disclosure.

FIG. 7 illustrates an example disassembly sequence of a modular component of forward assist assembly 100 in accordance with an implementation of the present disclosure. In the example shown in FIG. 6, as a modular component, button cover 130 may be slid off from the first distal end of plunger 110 downwardly with respect to upper receiver 200, which is generally in a direction at an angle θ measured from the longitudinal axis in a range of $30° \leq \theta \leq 150°$ (or $45° \leq \theta \leq 90°$) relative to the longitudinal axis of forward assist assembly 100. Furthermore, as another modular component, button cover 130 may be snapped off from the second primary side of button 120.

In view of the above, it is noteworthy that, after forward assist assembly 100 is installed on a firearm, there is no need for the user to remove or replace the entire forward assist assembly 100 for customization. Rather, the user would merely need to replace either or both of button cover 130 and button 120 with new component(s) which may have a different color, size, style, shape and/or surface texture than that of the incumbent component(s). Advantageously, the customization may be done quickly and without the need of any special tools.

It is noteworthy that the dimensions of various components of the proposed design may be adjusted to suit actual implementations. For instance, the overall size may be enlarged for implementation on a firearm of the AR10 platform (e.g., one chambered in 308 Winchester or 7.62×51 mm NATO). Similarly, the overall style may be changed. Likewise, the overall size may be reduced for implementation on a firearm of the AR15 platform (e.g., one chambered in 0.223 Remington or 5.56×54 mm NATO). It is also noteworthy that, with suitable adjustment to one or more components, forward assist assembly 100 may be made suitable to serve as a bolt charging handle as an alternative or additional use/function. It is further noteworthy that each component of forward assist assembly 100 may be made of a suitable material (e.g., a suitable metal such as steel, aluminum, alloy or polymer/plastics) with appropriate mechanical properties such as sufficient strengths and/or hardness to withstand vibrations caused by firing of ammunition cartridges.

It is further noteworthy that term "AR platform" herein refers to firearms based on the AR15 platform and the AR10 platform, as well as any variation and derivative thereof, and include AR15-styled and AR10-styled firearms, including rifles, carbines, pistols and shotguns. A firearm based on an AR platform may be chambered in one of a plethora of calibers. Some of the more popular calibers include such as, for example and without limitation, 0.223 Remington, 5.56×54 mm NATO, 0.224 Valkyrie, 300 AAC Blackout, 7.62×39 mm, 458 SOCOM, 6.5 mm Grendel, 6.8 mm Remington SPC, 308 Winchester and 7.62×51 mm NATO, just to name a few. Accordingly, the proposed design in accordance with the present disclosure may be implemented in any firearm based on the AR platform (whether the AR15 platform or the AR10 platform), as well as any variation and derivative thereof, in any suitable caliber.

Example Implementations

In view of the above, the proposed design of a modular forward assist may be implemented in many ways. For illustrative purposes and without limiting the scope of the present disclosure, a few example implementations of the proposed design are described below.

In one aspect, a device (e.g., device 100) implementable on a firearm based on an AR platform (e.g., AR15 platform or AR10 platform) may include a forward assist assembly configured to be installed on an upper receiver of the firearm. When pressed, the forward assist assembly may move along a longitudinal axis thereof to engage with a serration cut on a bolt carrier of the firearm to push the bolt carrier forward with respect to the upper receiver when pressed. The forward assist assembly may include a modular component slidingly attachable to and detachable from the forward assist assembly in directions at an angle θ measured from the longitudinal axis in a range of 30° e 150° (or 45°≤θ≤90°) relative to the longitudinal axis (e.g., 90° or perpendicular to the longitudinal axis).

In some implementations, the forward assist assembly may include a plunger and a button as a part of the modular component. The plunger, when the forward assist assembly is pressed by a user, may move along the longitudinal axis of the forward assist assembly to cause a bolt carrier of the firearm to move forward with respect to the upper receiver. The button may be configured to be slidingly attachable to and detachable from the plunger in directions at an angle θ measured from the longitudinal axis in a range of 30° e 150° (or 45°≤θ≤90°) relative to the longitudinal axis (e.g., 90° or perpendicular to the longitudinal axis).

In some implementations, the button may have a first primary side and a second primary side opposite the first primary side. The first primary side may be configured with two protrusions on two opposite ends of the first primary side. Each of the two protrusions may be configured with a groove. When the button is slidingly attached to the plunger, ledges on a first distal end of the plunger may be received in the grooves on the two protrusions.

In some implementations, the forward assist assembly may also include a button cover as another part of the modular component. The button cover may be configured to be detachably attached to the second primary side of the button.

In some implementations, the second primary side of the button may have an indentation configured to receive a mating portion of the button cover therein.

In some implementations, the second primary side of the button may also have a circumferential protrusion around in inner wall of the indentation. The mating portion of the button cover may have a circumferential groove around the mating portion thereof. When the button cover is attached to the second primary side of the button, the circumferential groove of the mating portion of the button cover may be received in the circumferential protrusion of the indentation of the button. Alternatively, the second primary side of the button may also have a circumferential groove around in inner wall of the indentation. The mating portion of the button cover may have a circumferential protrusion around the mating portion thereof. When the button cover is attached to the second primary side of the button, the circumferential protrusion of the mating portion of the button cover may be received in the circumferential groove of the indentation of the button.

In some implementations, the button may have a through hole communicatively connecting the first primary side and the second primary side of the button. When the button cover is attached to the button, a portion of the button cover may be exposed to the first primary side of the button via the through hole.

In some implementations, the forward assist assembly may further include a forward assist spring, a forward assist pawl, a pawl detent, a pawl detent spring, a pawl spring pin, and a plunger cover with a generally cylindrical shape. When the forward assist assembly is assembled and installed on the upper receiver of the firearm, the following may occur: (a) the button may be slidingly attachable to and detachable from the first distal end of the plunger, (b) the forward assist pawl may be secured to a second distal end of the plunger opposite the first distal end thereof by the pawl spring pin with the pawl detent and the pawl detent spring disposed between the plunger and the forward assist pawl, and (c) the plunger cover may surround the plunger with a first end of the plunger cover in contact with the button and a second end of the plunger cover opposite the first end thereof in contact with the forward assist spring.

In some implementations, each of the two protrusions on the first primary side of the button may have a notch. The first end of the plunger cover may correspondingly have two tabs. When the forward assist assembly is assembled, the two tabs on the first end of the plunger cover may be received in the notches of the two protrusions of the button.

In some implementations, the first end of the plunger cover may have a notch. When the forward assist assembly is assembled, a portion of the first distal end of the plunger may be visible through the notch of the plunger cover.

In another aspect, a device (e.g., device 100) implementable on a firearm based on an AR platform (e.g., AR15 platform or AR10 platform) may include a forward assist assembly configured to be installed on an upper receiver of the firearm. The forward assist assembly may include a plunger and a button. The plunger, when the forward assist assembly is pressed by a user, may move along a longitudinal axis of the forward assist assembly to cause a bolt carrier of the firearm to move forward with respect to the upper receiver. The button may be configured to be slidingly attached to and detached from the plunger in directions at an angle θ measured from the longitudinal axis in a range of $30° \leq \theta \leq 150°$ (or $45° \leq \theta \leq 90°$) relative to the longitudinal axis (e.g., 90° or perpendicular to the longitudinal axis).

In some implementations, the button may have a first primary side and a second primary side opposite the first primary side. The first primary side may be configured with two protrusions on two opposite ends of the first primary side. Each of the two protrusions may be configured with a groove. When the button is slidingly attached to the plunger, ledges on a first distal end of the plunger may be received in the grooves on the two protrusions.

In some implementations, the forward assist assembly may also include a button cover detachably attachable to the second primary side of the button.

In some implementations, the second primary side of the button may have an indentation configured to receive a mating portion of the button cover therein.

In some implementations, the second primary side of the button may also have a circumferential protrusion around in inner wall of the indentation. The mating portion of the button cover may have a circumferential groove around the mating portion thereof. When the button cover is attached to the second primary side of the button, the circumferential groove of the mating portion of the button cover may be received in the circumferential protrusion of the indentation of the button. Alternatively, the second primary side of the button may also have a circumferential groove around in inner wall of the indentation. The mating portion of the button cover may have a circumferential protrusion around the mating portion thereof. When the button cover is attached to the second primary side of the button, the circumferential protrusion of the mating portion of the button cover may be received in the circumferential groove of the indentation of the button.

In some implementations, the button may have a through hole communicatively connecting the first primary side and the second primary side of the button. When the button cover is attached to the button, a portion of the button cover may be exposed to the first primary side of the button via the through hole.

In some implementations, the forward assist assembly may further include a forward assist spring, a forward assist pawl, a pawl detent, a pawl detent spring, a pawl spring pin, and a plunger cover with a generally cylindrical shape.

In some implementations, when the forward assist assembly is assembled and installed on the upper receiver of the firearm, the following may occur: (a) the button may be slidingly attachable to and detachable from the first distal end of the plunger, (b) the forward assist pawl may be secured to a second distal end of the plunger opposite the first distal end thereof by the pawl spring pin with the pawl detent and the pawl detent spring disposed between the plunger and the forward assist pawl, and (c) the plunger cover may surround the plunger with a first end of the plunger cover in contact with the button and a second end of the plunger cover opposite the first end thereof in contact with the forward assist spring.

In some implementations, each of the two protrusions on the first primary side of the button may have a notch. The first end of the plunger cover may correspondingly have two tabs. When the forward assist assembly is assembled, the two tabs on the first end of the plunger cover may be received in the notches of the two protrusions of the button.

In some implementations, the first end of the plunger cover may have a notch. When the forward assist assembly is assembled, a portion of the first distal end of the plunger may be visible through the notch of the plunger cover.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A device implementable on a firearm, comprising:

a forward assist assembly configured to be installed on an upper receiver of the firearm and, when pressed, move along a longitudinal axis of the forward assist assembly to engage with a serration cut on a bolt carrier of the firearm to push the bolt carrier forward with respect to the upper receiver when pressed, the forward assist assembly comprising a modular component slidingly attachable to and detachable from the forward assist assembly;

a plunger which, when pressed, moves along the longitudinal axis of the forward assist assembly to cause the bolt carrier of the firearm to move forward with respect to the upper receiver; and a button as a part of the modular component and configured to be slidingly attached to and detached from the plunger, wherein the button has a first primary side and a second primary side opposite the first primary side, wherein the first primary side is configured with two protrusions on two opposite ends of the first primary side, wherein each of the two protrusions is configured with a groove, and wherein, when the button is slidingly attached to the plunger, ledges on a first distal end of the plunger are received in the grooves on the two protrusions; and wherein the forward assist assembly further comprises:

a button cover as another part of the modular component and configured to be detachably attached to the second primary side of the button.

2. The device of claim 1, wherein the second primary side of the button has an indentation configured to receive a mating portion of the button cover therein.

3. The device of claim 2, wherein the second primary side of the button further has a circumferential protrusion around in inner wall of the indentation, wherein the mating portion of the button cover has a circumferential groove around the mating portion thereof, and wherein, when the button cover is attached to the second primary side of the button, the circumferential groove of the mating portion of the button cover is received in the circumferential protrusion of the indentation of the button.

4. The device of claim 1, wherein the button has a through hole communicatively connecting the first primary side and the second primary side of the button, and wherein, when the button cover is attached to the button, a portion of the button cover is exposed to the first primary side of the button via the through hole.

5. The device of claim 1, wherein the forward assist assembly further comprises:

a forward assist spring;

a forward assist pawl;

a pawl detent;

a pawl detent spring;

a pawl spring pin; and a plunger cover with a generally cylindrical shape, wherein, when the forward assist assembly is assembled and installed on the upper receiver of the firearm:

the button is slidingly attachable to and detachable from the first distal end of the plunger, the forward assist pawl is secured to a second distal end of the plunger opposite the first distal end thereof by the pawl spring pin with the pawl detent and the pawl detent spring disposed between the plunger and the forward assist pawl, and the plunger cover surrounds the plunger with a first end of the plunger cover in contact with the button and a second end of the plunger cover opposite the first end thereof in contact with the forward assist spring.

6. The device of claim 5, wherein each of the two protrusions on the first primary side of the button has a notch, wherein the first end of the plunger cover correspondingly has two tabs, and wherein, when the forward assist assembly is assembled, the two tabs on the first end of the plunger cover are received in the notches of the two protrusions of the button.

7. The device of claim 5, wherein the first end of the plunger cover has a notch, and wherein, when the forward assist assembly is assembled, a portion of the first distal end of the plunger is visible through the notch of the plunger cover.

8. A device implementable on a firearm, comprising:

a forward assist assembly configured to be installed on an upper receiver of the firearm, comprising:

a plunger which, when pressed, moves along a longitudinal axis of the forward assist assembly to cause a bolt carrier of the firearm to move forward with respect to the upper receiver;

a button configured to be slidingly attached to and detached from the plunger;

wherein the button has a first primary side and a second primary side opposite the first primary side, wherein the first primary side is configured with two protrusions on two opposite ends of the first primary side, wherein each of the two protrusions is configured with a groove, and wherein, when the button is slidingly attached to the plunger, ledges on a first distal end of the plunger are received in the grooves on the two protrusions;

wherein the forward assist assembly further comprises: a button cover detachably attachable to the second primary side of the button; and wherein the second primary side of the button has an indentation configured to receive a mating portion of the button cover therein.

9. The device of claim 8, wherein the second primary side of the button has an indentation configured to receive a mating portion of the button cover therein.

10. The device of claim 8, wherein the second primary side of the button further has a circumferential protrusion around in inner wall of the indentation, wherein the mating portion of the button cover has a circumferential groove around the mating portion thereof, and wherein, when the button cover is attached to the second primary side of the button, the circumferential groove of the mating portion of the button cover is received in the circumferential protrusion of the indentation of the button.

11. The device of claim 8, wherein the button has a through hole communicatively connecting the first primary side and the second primary side of the button, and wherein, when the button cover is attached to the button, a portion of the button cover is exposed to the first primary side of the button via the through hole.

12. The device of claim 8, wherein the forward assist assembly further comprises:

a forward assist spring;

a forward assist pawl;

a pawl detent;

a pawl detent spring;

a pawl spring pin; and a plunger cover with a generally cylindrical shape.

13. The device of claim 12, wherein, when the forward assist assembly is assembled and installed on the upper receiver of the firearm:

the button is slidingly attachable to and detachable from the first distal end of the plunger, the forward assist pawl is secured to a second distal end of the plunger opposite the first distal end thereof by the pawl spring pin with the pawl detent and the pawl detent spring disposed between the plunger and the forward assist pawl, and the plunger cover surrounds the plunger with a first end of the plunger cover in contact with the button and a second end of the plunger cover opposite the first end thereof in contact with the forward assist spring.

14. The device of claim 13, wherein each of the two protrusions on the first primary side of the button has a notch, wherein the first end of the plunger cover correspondingly has two tabs, and wherein, when the forward assist assembly is assembled, the two tabs on the first end of the plunger cover are received in the notches of the two protrusions of the button.

15. The device of claim 13, wherein the first end of the plunger cover has a notch, and wherein, when the forward assist assembly is assembled, a portion of the first distal end of the plunger is visible through the notch of the plunger cover.

* * * * *